US010026383B2

(12) United States Patent
Cadwell et al.

(10) Patent No.: US 10,026,383 B2
(45) Date of Patent: Jul. 17, 2018

(54) LOCK FOR TREMOLO BRIDGE

(76) Inventors: Marcus L Cadwell, Colorado Springs, CO (US); Jeffrey Lathrop, Falcon, CO (US)

( * ) Notice: Subject to any disclaimer, the term of this patent is extended or adjusted under 35 U.S.C. 154(b) by 0 days.

(21) Appl. No.: 13/217,760

(22) Filed: Aug. 25, 2011

(65) Prior Publication Data

US 2014/0165817 A1 Jun. 19, 2014

(51) Int. Cl.
*G10D 3/00* (2006.01)
*G10D 3/14* (2006.01)

(52) U.S. Cl.
CPC ..... *G10D 3/146* (2013.01)

(58) Field of Classification Search
CPC ..... G10D 3/146
USPC ..... 84/313
See application file for complete search history.

(56) References Cited

U.S. PATENT DOCUMENTS 4,869,145 A * 9/1989 Evans ..... G10D 3/146 84/313

* cited by examiner

*Primary Examiner* — Jianchun Qin
(74) *Attorney, Agent, or Firm* — Zarley Law Firm, P.L.C.

(57) ABSTRACT

A vibrato bridge system includes a base plate. A mounting frame is attached to the base plate. An anchor mates with an edge of the base plate. A spring arm has a first end attached to the base plate and extending roughly perpendicular to the base plate. A spring has a first end attached to a second end of the spring arm. A spring anchor is attached to a second end of the spring. A magnetic latch is connected between the spring anchor and the second end of the spring arm. When the base plate is in its resting position the two magnets of the lock are essentially touching. The bracket has a pair of parallel slots and a stop pin extends through an end of the male sleeve and through the pair of slots.

4 Claims, 5 Drawing Sheets

LOCK FOR TREMOLO BRIDGE

RELATED APPLICATIONS

None

STATEMENT REGARDING FEDERALLY SPONSORED RESEARCH

Not Applicable

THE NAMES OF THE PARTIES TO A JOINT RESEARCH AGREEMENT

Not Applicable

REFERENCE TO A SEQUENCE LISTING, A TABLE, OR A COMPUTER PROGRAM LISTING

Not Applicable

BACKGROUND OF THE INVENTION

Tremolo bridges having tremolo activation levers, which are often called whammy bars, vibrato bars, or tremolo bars, that are designed so that the musician can easily add vibrato while playing the guitar. Vibrato is the periodic variation in a tone and tremolo is periodic variation in the amplitude. Because of this confusion, tremolo and vibrato will be used interchangeably herein. This is accomplished by having the base plate of the bridge pivoting on a fixed point or points. The vibrato arm is connected to the base plate and when the musician moves the vibrato arm the strings of the guitar (or other instrument) increase and decrease in tension. As a result, the tone varies periodically resulting in a vibrato effect.

One problem with tremolo bridges is that when a musician pulls (bends) on a string, the tension of the other strings are affected. This occurs because the base plate is balanced on pivot point (line or anchor) and increasing the tension on one string results in base plate moving from its resting position. When the base plate moves the tension on the other strings change. In most cases it causes the tuning of the other strings to go slightly flat. This is an undesirable side effect of tremolo bridges and negatively effects the quality of musical sound.

There have been attempts to solve this problem by adding counterbalancing springs with different spring constants to the tremolo bridge. However, these have been ineffective since the tremolo bridge is already balanced between the force of the strings and the springs on the tremolo bridge. Adding additional springs does not solve the problem.

Thus there exists a need for a tremolo bridge that does not result in the other strings going flat when one of the strings is tensioned. Note that while the present invention is described with respect to guitars, it is applicable to any string instrument.

BRIEF SUMMARY OF INVENTION

A vibrato bridge system that overcomes these and other problems includes a base plate. A mounting frame is attached to the base plate. An anchor mates with an edge of the base plate. A spring arm has a first end attached to the base plate and extending roughly perpendicular to the base plate. A spring has a first end attached to a second end of the spring arm. A spring anchor is attached to a second end of the spring. A magnetic lock is connected between the spring anchor and the second end of the spring arm. In one embodiment, the magnet latch includes a male sleeve with a permanent magnet attached to the inside of the male sleeve. A female sleeve has a permanent magnet attached to the inside of female sleeve. The male sleeve slides inside of the female sleeve. When the base plate is in its resting position the two magnets are essentially touching. In one embodiment, the male sleeve is attached to the spring arm by a bracket. The bracket has a pair of parallel slots and a stop pin extends through an end of the male sleeve and through the pair of slots. As a result, when the tremolo arm is lifted the magnet lock provides no resistance since the one end of the male sleeve just slides in the pair of slots. When the tremolo arm is pushed down however, the magnet lock initially provides strong resistance, but it quickly dissipates once the magnets are pulled apart. Due to the mechanical advantage provided by the tremolo arm the magnet lock has almost no effect on the tremolo bridge when the musician is operating the tremolo arm in a normal fashion. However, when the musician pulls or bends on a string, the magnet lock will provide sufficient resistance that the magnets cannot be pulled apart and the base plate will stay in its resting position. If the base plate stays in its resting position the remaining strings stay in perfect tune.

DETAILED DESCRIPTION OF THE INVENTION

A vibrato bridge system that overcomes these and other problems includes a base plate. A mounting frame is attached to the base plate. An anchor mates with an edge of the base plate. A spring arm has a first end attached to the base plate and extending roughly perpendicular to the base plate. A spring has a first end attached to a second end of the spring arm. A spring anchor is attached to a second end of the spring. A magnetic lock is connected between the spring anchor and the second end of the spring arm. In one embodiment, the magnetic latch includes a male sleeve with a permanent magnet attached to the inside of the male sleeve. A female sleeve has a permanent magnet attached to the inside of female sleeve. The male sleeve slides inside of the female sleeve. When the base plate is in its resting position the two magnets are essentially touching. In one embodiment, the male sleeve is attached to the spring arm by bracket. The bracket has a pair of parallel slots and a stop pin extends through an end of the male sleeve and through the pair of slots. As a result, when the tremolo arm is lifted the magnet lock provides no resistance since the one end of the male sleeve just slides in the pair of slots. When the tremolo arm is pushed down however, the magnet lock initially provides strong resistance, but it quickly dissipates once the magnets are pulled apart. Due to the mechanical advantage provided by the tremolo arm the magnet lock has almost no effect on the tremolo bridge when the musician is operating the tremolo arm in a normal fashion. However, when the musician pulls or bends on a string, the magnet lock will provide sufficient resistance that the magnets cannot be pulled apart and the base plate will stay in its resting position. If the base plate stays in its resting position the remaining strings stay in perfect tune.

Figure 1:
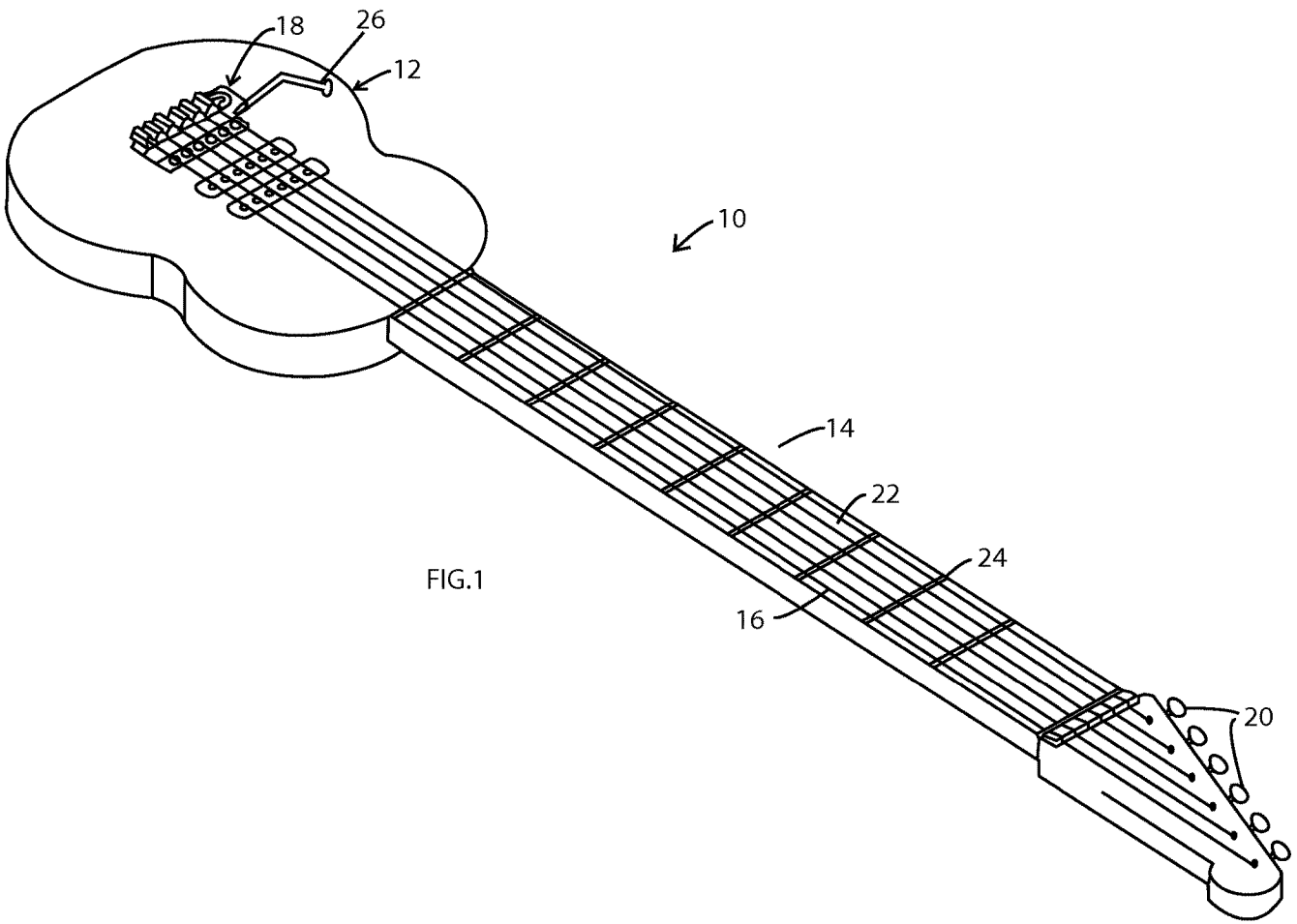
FIG. 1 is a perspective view of a guitar that can be used with the invention in accordance with one embodiment of the invention.

FIG. 1 is a perspective view of a guitar 10 that can be used with the invention in accordance with one embodiment of the invention. A guitar 10 includes a guitar body 12 having a neck 14 extending therefrom. Strings 16 extend from a bridge 18 to tuning pegs 20 along the guitar 10. The strings 16 are positioned over a finger board 22 on the neck 14, where the finger board 22 includes frets 24 extending therefrom. The guitar 10 has a tremolo bar 26 extending from the bridge 18.

Figure 2:
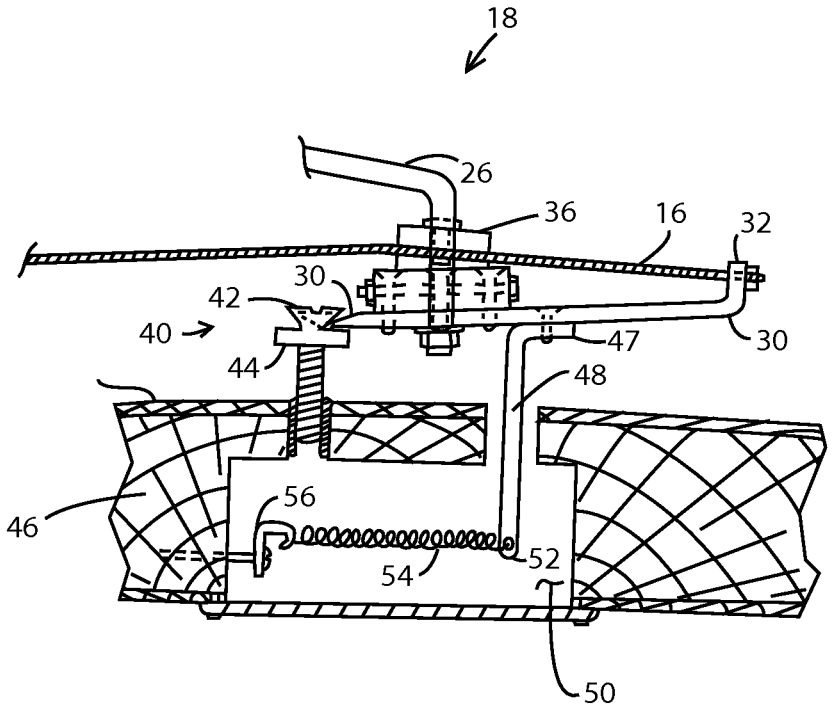
FIG. 2 is a cross sectional view of a tremolo bridge that can be used with the invention in accordance with one embodiment of the invention.

FIG. 2 is a cross sectional view of a tremolo bridge 18 that can be used with the invention in accordance with one embodiment of the invention. The tremolo bridge has a base plate 30 have a first edge 32 holding an end of the strings 16. The strings 16 extend over mounting frame 36 attached to the base plate 30. The tremolo bar 26 is attached to the base plate. A second edge 38 of the base plate 30 forms a knife point that mates with the anchor 40, formed in this case by a screw head 42 and a flanged shoulder 44. The screw is attached to the body 46 of the guitar 10. The base plate 30 is connected to a first end 47 of a spring arm 48 that extends roughly perpendicular to the base plate 30. The spring arm 48 extends through the guitar body 46 into a tremolo cavity 50. A second end 52 of the spring arm 48 is connected to a first end of a spring 54. The second end of the spring 54 is connected to a spring anchor 56. Note that the base plate 30 is balanced on the anchor 40 by the tension of the strings 16 and the tension provided by the spring(s) 54 through the spring arm 48.

Figure 3:
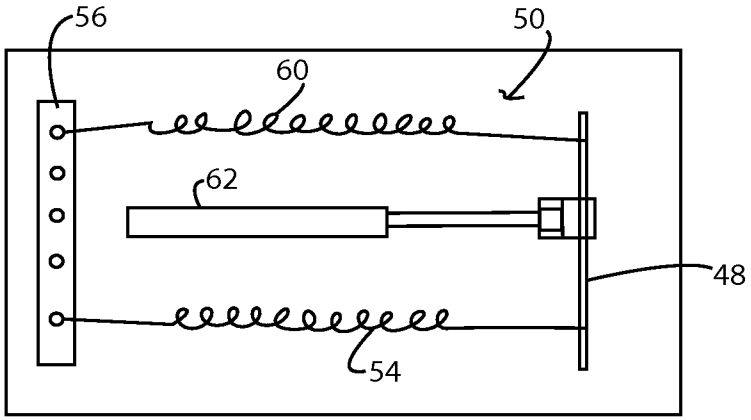
FIG. 3 is an underside view of a tremolo bridge in accordance with one embodiment of the invention.

FIG. 3 is an underside view of a tremolo bridge in accordance with one embodiment of the invention. This view shows the cavity 50 of the tremolo bridge of FIG. 2. This figure shows two springs 54 and 60 between the spring arm 48 and the spring anchor 56. It also shows a magnet lock 62, which will be explained in more detail with respect to FIGS. 4-6.

Figures 4, 5:
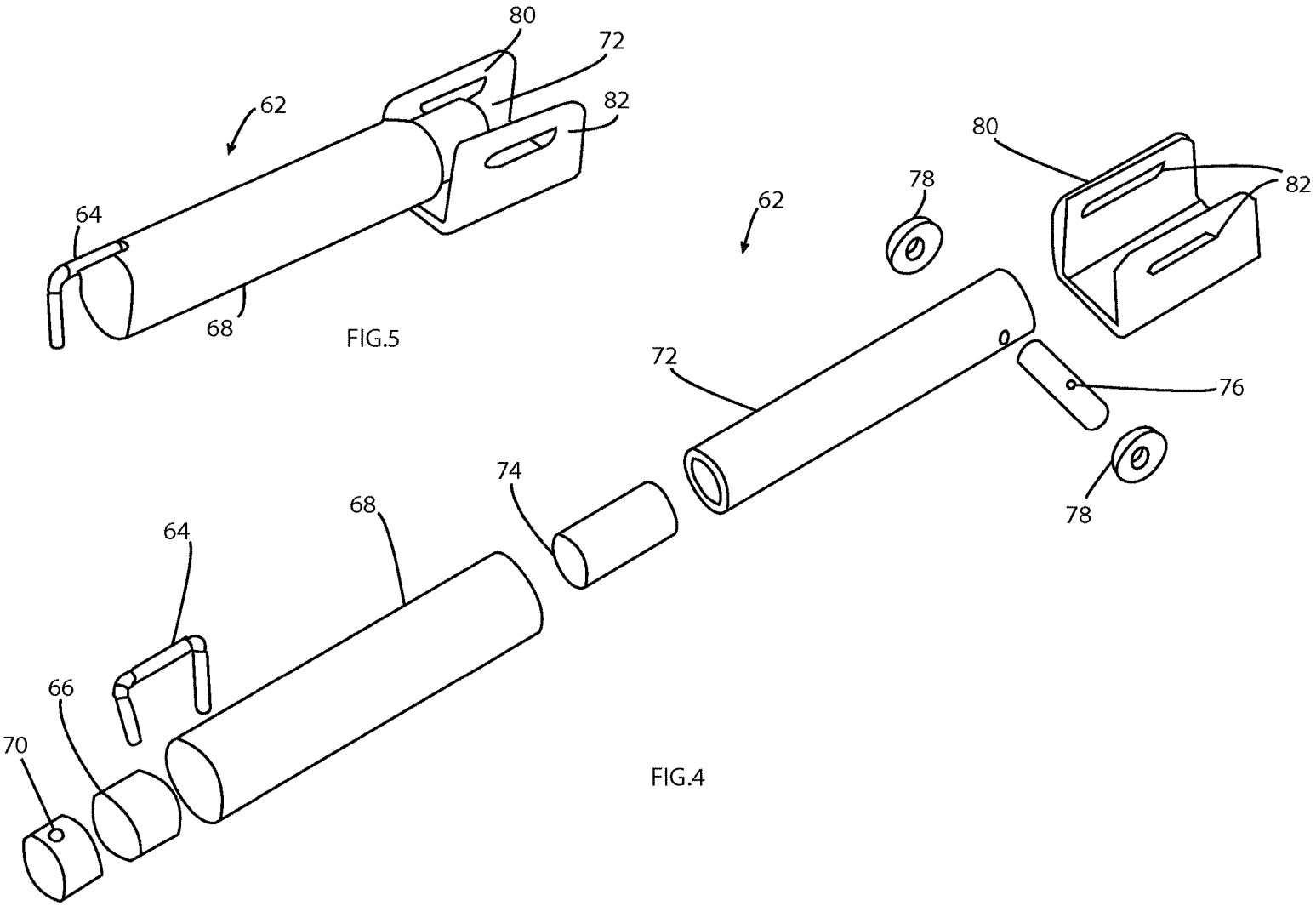
FIG. 4 is a perspective exploded view of a lock for a tremolo bridge in accordance with one embodiment of the invention.
FIG. 5 is a perspective view of a lock for a tremolo bridge in accordance with one embodiment of the invention.

FIG. 4 is a perspective exploded view of a lock 62 for a tremolo bridge in accordance with one embodiment of the invention. The lock 62 has a wire clip 64 that connects to the spring anchor 56. A magnet 66 is inserted into the female sleeve 68 and held in place by an adhesive of a rib. A pole piece 70 fits into the end of the female sleeve 68 and mates with the wire clip 64. A male sleeve 72 slides inside the female sleeve 68. A magnet 74 fits inside and is attached to the female sleeve 72 and is held in place by adhesive or other suitable means. A pin 76 extends through a second end of the male sleeve 72 and a pair of washers 78. A bracket 80 has a pair of slots 82 and the stop pin 76 extends through the slots 82. The bracket is attached to the spring arm 48. The male 72 and female 68 sleeves form a guide. Other guide systems could be used to hold the magnets in proximity with each other as will be apparent to those skilled in the art. These guide systems are part of this invention. Roughly the assembled female sleeve forms a first section and the assembled male sleeve forms a second section. The magnets 66, 74 may be rare earth magnets. In one embodiment, one of the magnets may be replaced by a ferroelectric material.

FIG. 5 is a perspective view of a lock 62 for a tremolo bridge in accordance with one embodiment of the invention. This view shows the assembled lock 62. When the tremolo bridge 18 or base plate 30 is at a resting position, meaning the musician is not apply tension to the strings or pressing on the tremolo bar 26, the magnets 66, 74 are essentially touching. When the musician lifts the tremolo bar 26 the stop pin 76 slides in the slots 82 towards the spring bar 48. When the musician depresses the tremolo bar 26 the bracket pulls on the stop pin 76 and the magnets 66, 74 are pulled apart, assuming sufficient pressure is applied. When the musician pulls on a string 16, the magnets 66, 74 have sufficient attractive strength to ensure that the bond between the magnets is not broken (they do not move relative to each other). As a result, the other strings do not suffer a reduction in tension and become flat.

Figure 6:
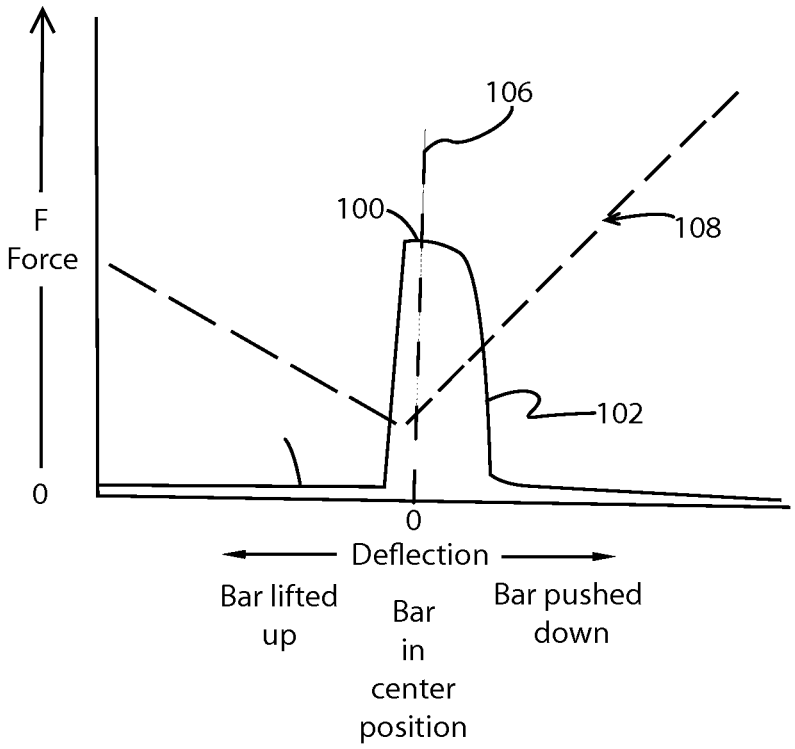
FIG. 6 is a graph of the attractive force vs. distance of the magnet lock in accordance with one embodiment of the invention.

FIG. 6 is a graph of the attractive force vs. distance of the magnet lock in accordance with one embodiment of the invention. The graph shows force on the vertical scale and deflection on the horizontal scale. The graph shows the attractive force between the magnets. When the magnets are touching 100 the attractive force is a maximum. When the tremolo bar 26 is depressed, which is shown as distance to the right of the graph, then the force 102 between the magnets falls as a square of the distance between the magnets. If the tremolo bar 26 is lifted above its resting position, then the male sleeve 72 slides in the bracket 80 and the magnets 66, 74 are still in contact. As a result, the only force 104 exerted by the lock 62 is the friction of the pin 76 sliding in the bracket 80. Note that the un-deflected bar is show 106 as the center of the graph. The dashed line 108 shows the force exerted by springs with different spring constants holding the bar. The springs will never provide the correct force versus deflection curve to solve the present problem.

Thus there has been described a lock for a tremolo bridge that does not result in the other strings going flat when one of the strings is tensioned (pulled on). Note that while the present invention is described with respect to guitars, it is applicable to any string instrument.

While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

What is claimed is:

1. A vibrato bridge system, comprising:

a base plate;

a mounting frame attached to the base plate;

an anchor mating with an edge of the base plate;

a spring arm having a first end attached to the base plate and extending roughly perpendicular to the base plate;

a spring having a first end attached to a second end of the spring arm;

a spring anchor attached to a second end of the spring;

a magnet lock connected between the spring anchor and the second end of the spring arm;

wherein the magnet lock includes a first magnet mechanically attached to the spring anchor and a second magnet mechanically attached to a second end of the spring arm; and wherein the first magnet is mounted in a female sleeve.

2. The vibrato bridge of claim 1, wherein the second magnet is mounted in a male sleeve.

3. The vibrato bridge of claim 1, wherein the magnet lock has a bond that decreases in strength as a distance away from a resting position increases.

4. The vibrato bridge of claim 3, further including a bracket having a pair slot groove that mate with a stop pin of a male sleeve.

* * * * *